US008172499B2

(12) United States Patent
Grenon

(10) Patent No.: US 8,172,499 B2
(45) Date of Patent: May 8, 2012

(54) PORTABLE RAISE CLIMBING SYSTEM

(75) Inventor: Randy E. Grenon, Sudbury (CA)

(73) Assignee: J.S. Redpath Limited, North Bay (CA)

( * ) Notice: Subject to any disclaimer, the term of this patent is extended or adjusted under 35 U.S.C. 154(b) by 0 days.

(21) Appl. No.: 13/221,653

(22) Filed: Aug. 30, 2011

(65) Prior Publication Data

US 2011/0308890 A1 Dec. 22, 2011

Related U.S. Application Data

(63) Continuation of application No. 12/142,276, filed on Jun. 19, 2008, now Pat. No. 8,021,098.

(60) Provisional application No. 60/945,199, filed on Jun. 20, 2007.

(51) Int. Cl.
*B66F 9/10* (2006.01)

(52) U.S. Cl. ..... 414/629; 414/391; 182/82; 187/245

(58) Field of Classification Search ..... 414/427, 414/629; 248/295.11, 235; 182/37, 82; 104/127, 104/128, 129; 105/31, 29.1; 187/240, 244, 187/245

See application file for complete search history.

(56) References Cited

U.S. PATENT DOCUMENTS

| | | | |
|---|---|---|---|
| 124,751 | A | 8/1933 | Porter |
| 3,016,989 | A | 1/1962 | Lindmark |
| 3,136,433 | A | 6/1964 | Inghram |
| 3,378,106 | A | 4/1968 | Wegner |
| 3,589,490 | A | 6/1971 | Walkhoff et al. |
| 3,627,079 | A | 12/1971 | Nielsen et al. |
| 3,666,127 | A | 5/1972 | Guyaux |
| 3,675,433 | A | 7/1972 | Silvestrov et al. |
| 3,830,338 | A | 8/1974 | Svensson |
| 4,026,388 | A | 5/1977 | Creissels |
| 4,050,546 | A | 9/1977 | Wilson, Jr. |
| 4,054,218 | A | 10/1977 | Mackey |
| 4,411,583 | A | 10/1983 | Petitto, Sr. et al. |
| 4,771,881 | A | 9/1988 | Roberts |
| 4,890,972 | A | 1/1990 | Nekola et al. |
| 4,986,374 | A | 1/1991 | Niemi et al. |
| 5,489,181 | A | 2/1996 | Greaves |
| 5,533,594 | A | 7/1996 | Tremblay et al. |
| 5,582,467 | A | 12/1996 | Drolet et al. |
| 6,308,802 | B1 | 10/2001 | Briere |
| 6,474,929 | B1 | 11/2002 | Hartman |

FOREIGN PATENT DOCUMENTS

| | | |
|---|---|---|
| CA | 986542 | 3/1976 |
| CA | 990317 | 6/1976 |
| CA | 1195292 | 10/1985 |
| GB | 1378318 | 12/1974 |

*Primary Examiner* — Dean Kramer
*Assistant Examiner* — Stephen Vu
(74) *Attorney, Agent, or Firm* — Brett J. Slaney; John R.S. Orange; Blake, Cassels & Graydon LLP

(57) ABSTRACT

A portable raise climbing system is provided that comprises a starter box for interfacing with an existing raise climb track, a raise climber that is deployed by the system onto the existing track for normal raise excavation operations, and a transporter. The transporter is configured to carry the raise climber from site to site by interfacing with moving equipment. The moving equipment preferably includes a front hydraulic quick connect/disconnect lift system, e.g. front-end loader, forklift, plough, scooptram, etc.

3 Claims, 7 Drawing Sheets

PORTABLE RAISE CLIMBING SYSTEM

CROSS-REFERENCE TO RELATED APPLICATIONS

This application is a continuation of U.S. application Ser. No. 12/142,276 filed Jun. 19, 2008 (now issued as U.S. Pat. No. 8,021,098), which claims priority from U.S. Application No. 60/945,199 both incorporated herein by reference.

TECHNICAL FIELD

The following relates generally to excavation equipment and has particular utility in raise climbing systems.

BACKGROUND

It is sometimes required in an underground mine, to provide access from a lower level L thereof to an upper level U thereof, as shown in FIG. 1. A mine owner may request that a raise excavation R be created from the lower level L to the upper level U, which is of a certain size/configuration and length. The raise R may be used to serve a variety of purposes such as air ventilation, secondary personnel access/egress or as material dump chutes.

To create the raise excavation R, a pilot or access drift A is first excavated from the main mine drift D to the proposed raise location. This provides access to the raise for both personnel and muck removal equipment (not shown). As can be seen in FIG. 1, a muck pile M typically forms at the bottom of the raise R as it is being excavated.

An additional excavation N is typically made into the pilot or access drift A immediately adjacent to the raise location, to install an elevated working nest or parking area P for raise climbing equipment commonly referred to as a 'raise climber' 10. The raise climber 10 travels along a rail 12 and is used to start and muck the raise excavation R as is well known in the art. As the raise R is excavated, muck piles M accumulate at the bottom of the raise R and are then removed. The additional excavation N enables the raise climber 10 to retreat into the access drift A and avoid contact with the falling muck (rock) which occurs after a blast or when scaling.

To assist personnel in loading/unloading and entering/exiting the raise climber 10, a suspended deck, typically made of timber, is hung at the proposed parking area P. The decking is suspended using a series of chains/turnbuckles or other devices. The lower level of the access drift A is then clear for access by the mucking equipment so that the material can be removed as required. The parking area P can also be used by personnel to load supplies and to move into and out of the site.

A typical process for excavating a raise R includes driving the raise climber 10 to the face of the raise R, drilling a round of holes, loading the holes with explosives, returning to the parking area P, detonating the explosives, clearing the muck, adding rail 12 as necessary, and repeating until the raise R reaches the upper level U.

Problems with traditional parking areas P at raise excavation sites, e.g. as shown in FIG. 1, are that it is i) costly to excavate; ii) cannot be reused for any beneficial purpose once the raise R has been excavated; and iii) due to the relatively large excavation required, there is an added measure of instability in the parking area P that needs to be rectified with additional rock stabilization methods. As such, this upper area (excavation) N has no value after the raise excavation is complete.

Another problem is that, although moving the raise climber 10 into the additional excavation N and above the parking area P removes the raise climber 10 from the direct path of the falling debris accumulating in the muck pile M, both the raise climber 10 and the decking timber may still interfere with the muck removal equipment and would require regular maintenance and repairs. The elevated work platform also introduces safety concerns as access for workers and materials is provided via a ladder way. The raise end of the platform has limited protection as the raise climber 10 traverses the area on its way to and from the raise R.

Yet another problem with the excavation site shown in FIG. 1 is that the raise climber 10 is idle while blast material is being removed from the site. Moreover, when multiple raises are needed in the same mine, multiple raise climbing systems may be employed to excavate each site simultaneously, or a single unit used independently and in sequence, when in close proximity to each other, which can be time consuming and expensive.

It is therefore an object of the following to obviate or mitigate the above-noted disadvantages.

SUMMARY

In one aspect, there is provided a portable raise climbing system comprising a starter block configured to interface with an existing rail situated in a raise; and a transporter configured to interface with the starter block and having a portion configured to carry a raise climber, the transporter also comprising an interface to permit movement thereof towards and away from the starter block.

In another aspect, a portable raise climber transporter is provided comprising a body configured to carry a raise climber; a first interface for aligning the body with an existing rail to enable the transporter to deploy the raise climber thereon; and a second interface for attaching the transporter to a transport vehicle.

In yet another aspect, a starter block is provided for deploying a raise climber onto an existing rail, the starter block comprising a body with a rail configured to align with the existing rail; a first interface for mating with the existing rail; and one or more sockets for receiving corresponding spears of a transporter for alignment thereof.

BRIEF DESCRIPTION OF THE DRAWINGS

An embodiment of the invention will now be described by way of example only with reference to the appended drawings wherein.

DETAILED DESCRIPTION OF THE DRAWINGS

Figure 1:
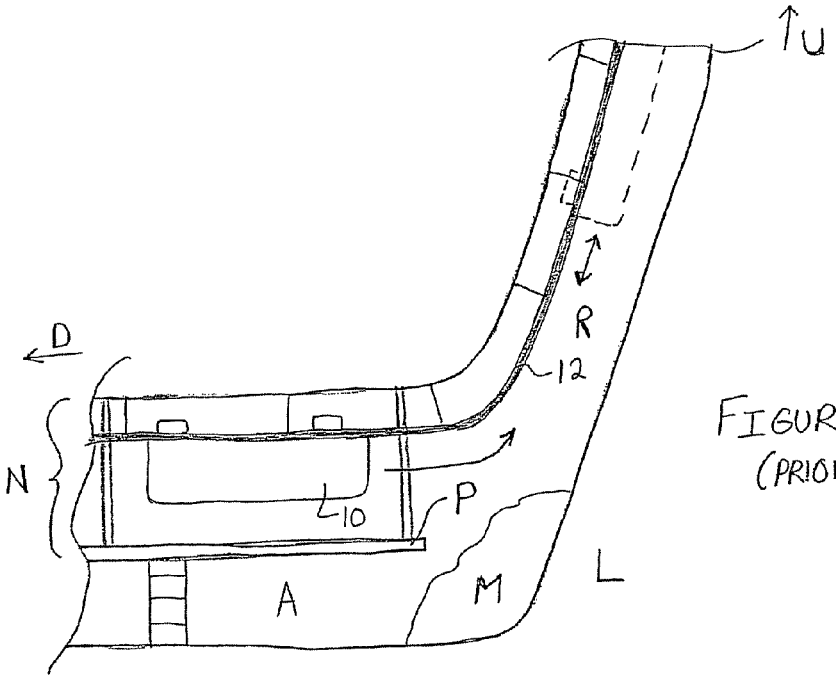
FIGURE 1 (PRIOR ART)
FIG. 1 is a sectional diagram showing a prior art nesting station for a raise climber along the line A-A in FIG. 2.
Figure 2:
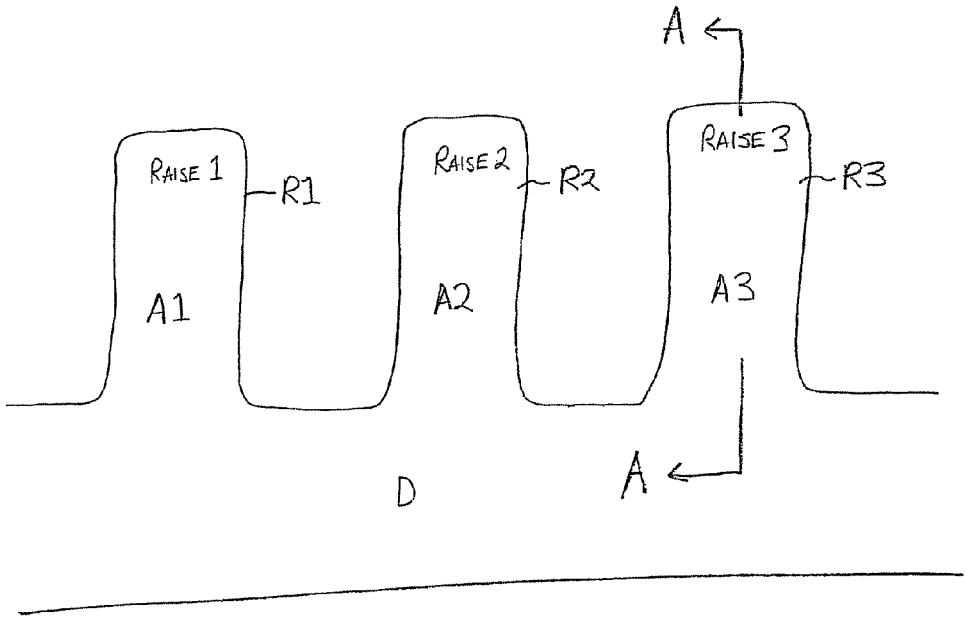
FIG. 2 is a schematic diagram showing a haul drift with multiple adjoining access drifts for accessing multiple raise excavation sites.
Figure 3:
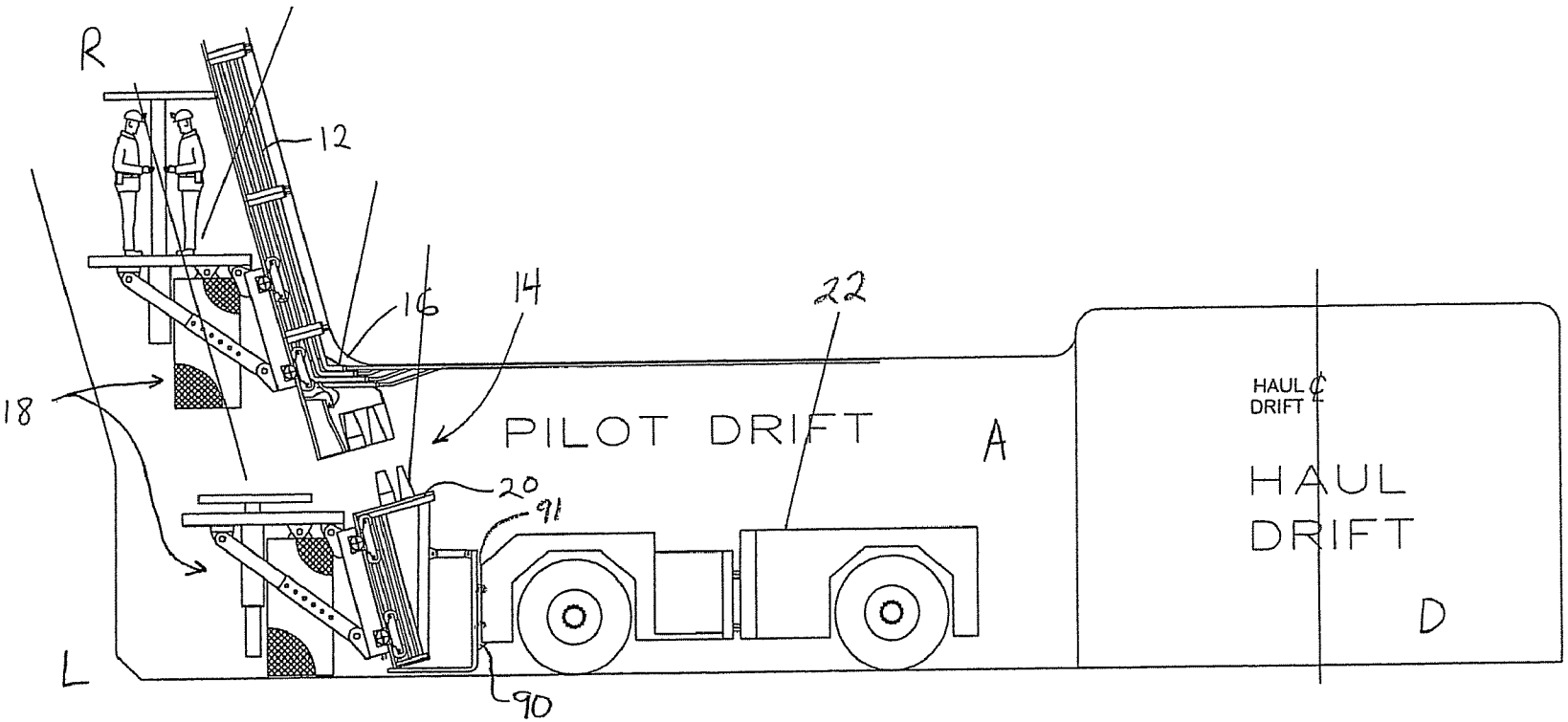
FIG. 3 is an elevation view of a raise excavation site utilizing a portable raise climbing system.

Referring now to FIG. 2, a main drift or haul drift D is shown, which has multiple access drifts (three in this example) A1, A2 and A3 that provide access to corresponding raise excavation sites R1, R2 and R3 respectively. When multiple raises R are required in the same general area (or mine) as shown in FIG. 2, traditionally, a single unit working independently and in sequence or multiple raise climbing systems such as the raise climber 10 shown in FIG. 1 would be required in each access/raise. As noted above, this can be expensive and will result in at least some idle time for each raise climber 10. To overcome these problems, a portable raise climbing system 14, as shown in FIG. 3, is connected to existing rail 12 that is normally installed along a wall of the raise R.

The portable raise climbing system 14 comprises a starter box 16 for interfacing with the existing rail 12, a raise climber 18 that is deployed by the system 14 onto the existing rail 12 for normal raise excavation operations, and a transporter 20. The transporter 20 is configured to carry the raise climber 18 from site to site by interfacing with moving equipment 22. The moving equipment 22 preferably includes a front hydraulic quick connect/disconnect lift system 90, e.g. front-end loader, forklift, scooptram, etc. that interfaces with quick coupling lugs 91 on the transporter 20.

Further details of the portable raise climbing system 14 can be seen in FIGS. 4-7.

Figure 4:
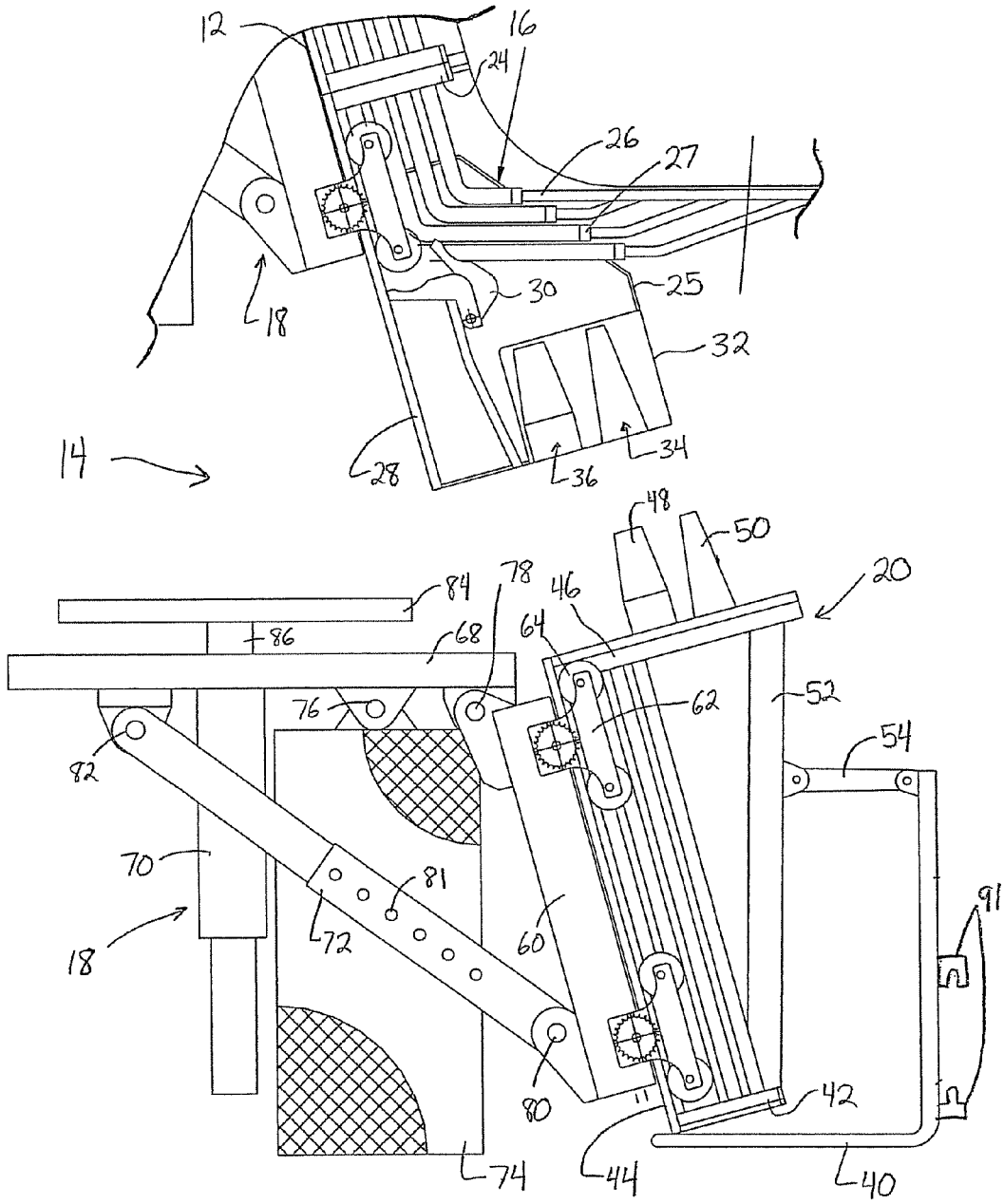
FIG. 4 is an enlarged view of a portion of the system shown in FIG. 3.
Figure 5:
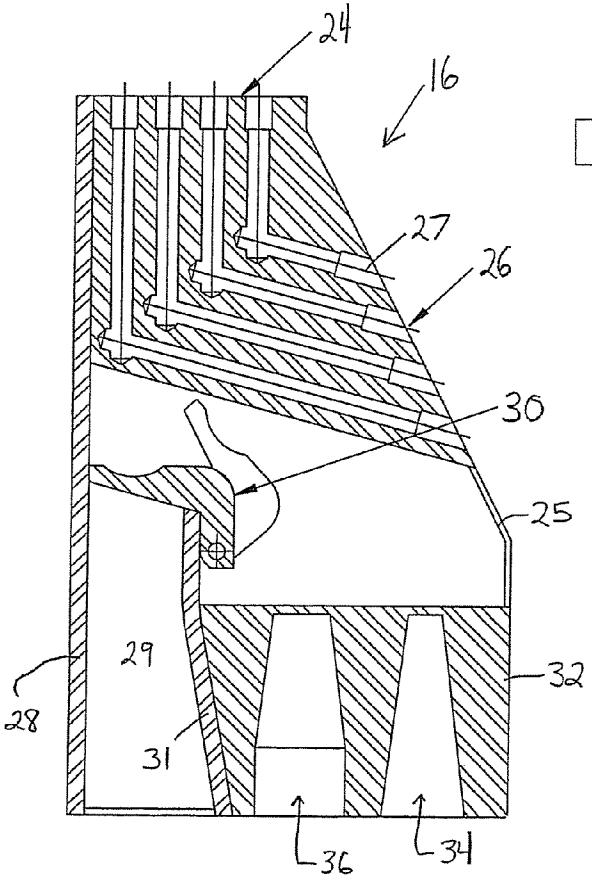
FIG. 5 is a sectional view of the rail starter box shown in FIG. 4.

The starter box 16, seen in FIGS. 4 and 5, is configured to mate with the endmost section of existing rail 12 such that the raise climber 18 can be deployed onto the rail 12 from below. As such, only the 'vertical' portion of the rails used to create the rail 12 is required and thus no curved rail is needed and rail is not required to be installed in the access drift A. As seen in FIG. 5, the starter box 16 has a substantially hollow body 25 with a flange 24 at an upper portion thereof that includes the necessary fastening mechanisms to mate with the existing rail 12 without requiring modification of the rail 12. The body 25 also carries a manifold block 26 containing the mine services for the raise climber 18 and includes hose quick connects 27.

A rail 28 is included along the entire length of the 'track side' of the starter box 16 for loading and unloading the raise climber 18. An internal guide 31 may also be included opposite the rail 28 to define a channel 29. The channel 29 is sized according to accommodate movement of the raise climber trolley wheels 64 along the rail 28. Attached to the upper end of the guide 31 is a safety stop 30 that can pivot between locked and unlocked positions. In the locked position (hatched version), movement of the raise climber 18 in a downward direction beyond the starter box 16 is inhibited, whereas in the unlocked position, the raise climber 18 may move past the channel 29, e.g. when unloading the raise climber 18 from the rail 12 and onto the transporter 20.

The lower end of the body 25 also includes a guide block 32 that includes one or more tapered sockets, in this example two differently sized, tapered sockets 34 and 36. The guide block 32 provides a mating socket for the transporter 20 that preferably enables only one orientation of the transporter 20 to fit into the starter block 16, which avoids incorrect loading/unloading of the raise climber 18.

Figure 6:
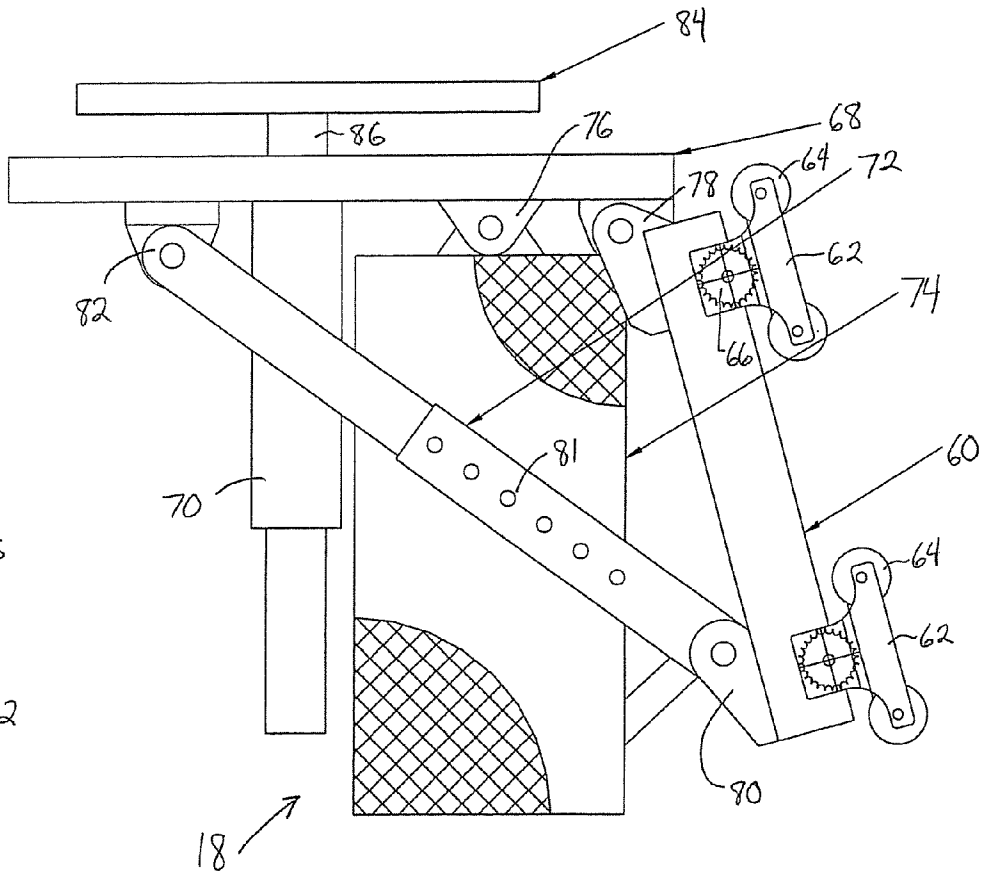
FIG. 6 is an elevation view of the raise climber shown in FIG. 4.

The raise climber 18 is shown in FIGS. 4 and 6. The raise climber 18 comprises a trolley 60, which is preferably the same or similar to existing raise climber trolleys (e.g. as shown in FIG. 1) to ensure that the trolley 60 is compatible with the existing rail 12. The trolley 60 includes a pair of supports 62 providing axes to enable rotation of the trolley wheels 64. The supports 62 also house the drive sprockets 66, which interact with the rail 28 and drive track (not shown) on the existing rail 12 as is well known in the art. The trolley 60 includes an upper pivotal connection 78 and a lower pivotal connection 80. An adjustable work deck 68 is attached to the upper connection 78 and includes a distal pivotal connection 82. An adjustable arm 72, with a series of stop positions 81, is connected to the distal connection 82 and the lower connection 80 on the trolley 60. The adjustable arm 72 enables the worker to adjust the dip angle of the work deck 68 to accommodate differently angled raises R. Pivotally connected at 76 to the work deck 68 and suspended from the underside thereof is a man-basket 74.

The work deck 68 also includes a receiver box 70 for receiving a stem 86, and a collapsible canopy 84 is attached to the upper end of the stem 86. The stem 86 can be extended (see FIG. 3) or retracted (see FIG. 6), as desired by the worker.

Figure 7:
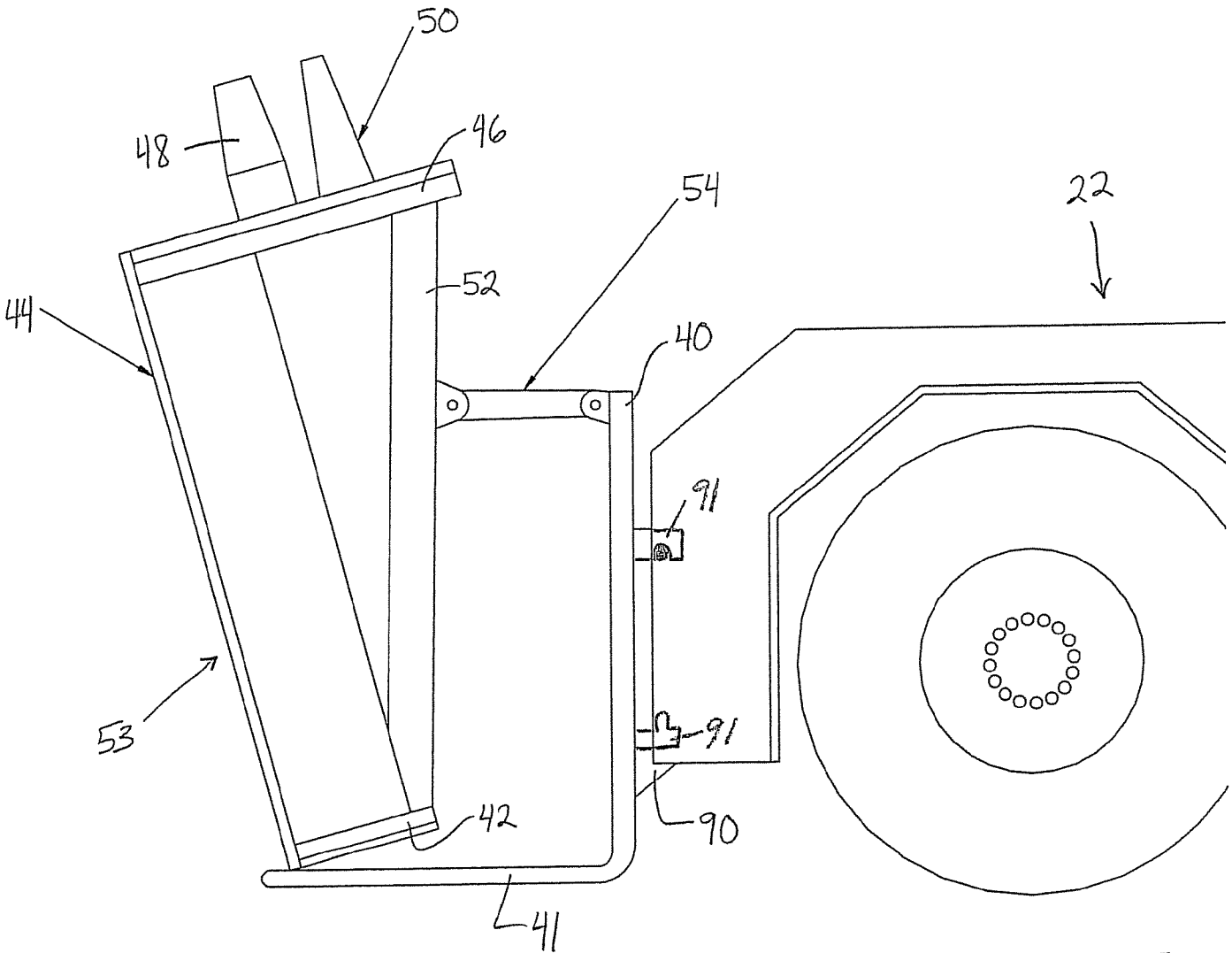
FIG. 7 is an elevation view of the transport rail shown in FIG. 4 coupled to a transport vehicle.

The transporter 20 is shown in FIGS. 4 and 7. The transporter 20 comprises an upstanding wall 40 and a base plate 41 that are, in this example, formed from a single bent sheet of material such as steel. The wall 40 is configured to interface with a quick connect/disconnect system 90, 91 on the transporter vehicle 22. The upper end of the wall 40 includes a linkage 54 that is connected to a transfer section 53. The transfer section 53 includes a rail 44 that is positioned to be aligned with the rail 28 on the starter box 16, and two end walls 46 and 42. The upper end wall 46 extends from the rail 44 in a perpendicular direction and is sized to couple with and be aligned with the channel 29 and the guide block 32 on the starter box 16. The lower end wall 42 also extends from the rail 44 in a perpendicular direction and provides a stopping mechanism for the raise climber 18 as shown in FIG. 4. A support 52 extends between the walls 42, 46 and provides a member for connecting the linkage 54 to the transfer section 53. The outwardly facing surface of the wall 46 includes a set of spears, in this example two tapered spears 48 and 50, which are sized to be received by the corresponding sockets 36 and 34 as best shown in FIG. 4. It can be appreciated that the rail 44 extends outwardly from the wall 46 to permit passage of the trolley 60 to enable the raise climber 18 to enter and exit the transporter 20.

Figure 8:
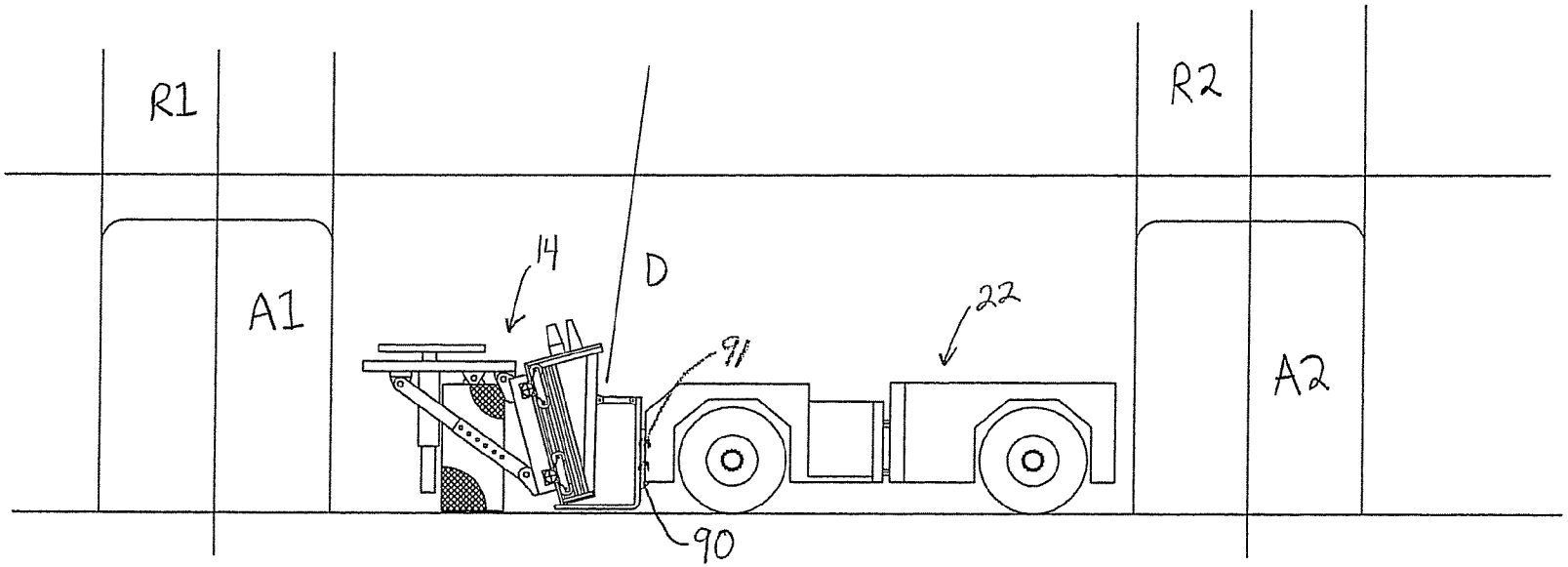
FIG. 8 is an elevation view of a portion of the haul drift of FIG. 2 illustrating transportation of the raise climber through the haul drift.
Figure 9:
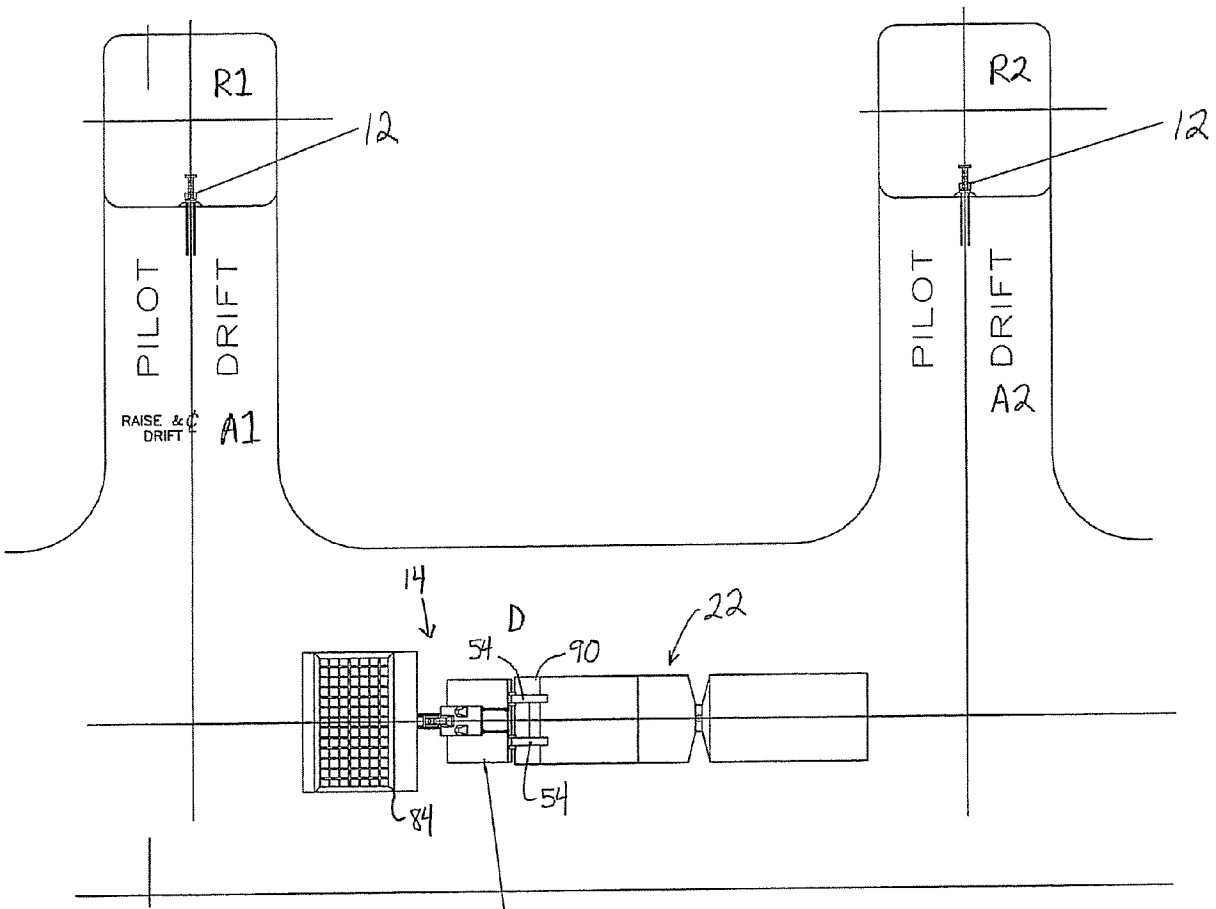
FIG. 9 is an plan view of a portion of the haul drift of FIG. 2 illustrating transportation of the raise climber through the haul drift.

Referring also now, to FIGS. 8 and 9, the portable raise climbing system 14 is preferably intended to be transported between different raise excavation sites R, e.g. R1 and R2. In this way, when, e.g., R1 is being blasted, the raise climbing system 14 can be deployed in R2 to set the explosives. This eliminates much of the idle time in existing raise climbing systems 10. It will be appreciated that multiple starter boxes 16 may be used, e.g. one at each raise R, or may be detached and moved with the raise climber 18 with each relocation.

The use of a portable raise climbing system 14 reduces, if not eliminates, the down time for crew and equipment; eliminates the need for costly and structurally compromising excavations N to accommodate a timber deck for nesting the raise climber 10; reduces the cavity size at the mouth of the raise R, which is inherently safer; and enables the portable raise climber 18 (as well as the other components of system 14) to be serviced at a surface maintenance shop rather than at the raise site R, eliminating the need to store and duplicate repair equipment for use in the mine. All of the these advantages can translate into substantial savings of time and money for a job.

The following example illustrating the use of the portable raise climbing system 14 first assumes that the raise climber 18 is already deployed on the rail 12. To move the raise climber 18 to another site, the transporter 20, if not already, is first coupled to the transporter vehicle 22 using the quick connect system 90, 91 as shown in FIG. 7. The transporter vehicle 22 may then be tilted, lifted and otherwise adjusted to orient the rail 44 such that it is generally aligned with the rail 28 on the starter box 16. The transporter vehicle 22 is then moved into the appropriate raise R. The transporter 20 is then lifted towards the starter block 16 and the spears 48 and 50 are received by the sockets 36 and 34 respectively to provide a final orientation of the transporter 20 and the starter block 16. The safety stop 30 may then be placed in the unlocked position, either manually or using a control system if applicable (not shown). This opens the channel 29 to the trolley 60 in turn enabling the raise climber 18 to be transferred from the starter box 16 into the transporter 20. The transporter vehicle 22 then lowers the transporter 20 with sufficient clearance from the starter box 16 above and the floor of the drift A below. The transporter vehicle 22 is then driven into another raise R, e.g. R2.

To load the raise climber 18 onto another rail 12, the transporter vehicle 22 first positions the transporter 20 beneath the starter box 16 (or first installs the starter box 16 if appropriate and then positions itself) as shown in FIG. 3. The transporter 20 is then lifted towards the starter box 16 and the spears 48, 50 and sockets 36, 34 engage as before to align the rails 44 and 28. The raise climber 18 may then be driven through the starter box 16 and deployed onto the rail 12 as also shown in FIG. 3. Once the raise climber 18 passes through the channel 29 and past the safety stop 30, the safety stop 30 preferably engages into the locked position to prevent the raise climber 18 from being released when the transporter vehicle 22 retreats from the raise R. The transporter vehicle 22 then lowers the transporter 20 if it is needed elsewhere, or waits for the raise climber 18 to set the explosives and return, at which time the raise climber 18 can be moved back to the previous raise R, or to a new raise R.

It can therefore be seen that use of the portable raise climbing system 14, in particular where a site includes multiple raises R reduces the down time of the raise climber 18 and reduces the amount of equipment needed. Moreover, the raise climber 18 can more easily be serviced at the surface rather that down in the excavation site. By providing a starter block 16 and transporter 20, the raise climber 18 can be loaded and unloaded onto existing rail 12 that would normally be needed to ascend and descend in the raise R. The bent portion and length of rail 12 within the access drift A is eliminated as well as the need for an additional excavation N to accommodate nesting of the raise climber 10.

It will be appreciated that the components shown in the figures can be modified according to variations in the configuration, sizes etc. of the rail 12, raise climber 18 and transporter vehicle 22, and should not be limited to what is shown.

As such, although the invention has been described with reference to certain specific embodiments, various modifications thereof will be apparent to those skilled in the art.

The invention claimed is:

1. A method of enabling a raise climber to be useable in a plurality of raises in a mine, the method comprising:

for each of a plurality of said raises, attaching a respective one of a plurality of starter blocks to an existing rail used in a corresponding one of said plurality of raises, each of said starter blocks comprising a respective first body with a first rail configured to align with said existing rail used in a respective raise, a first interface for mating with the existing rail used in the respective raise to facilitate movement of said raise climber from said starter block onto said existing rail, and a second interface for mating with a transporter carrying said raise climber to facilitate movement of said raise climber from said transporter to said starter block;

supporting said transporter on a transport vehicle, said transporter comprising a second body with a second rail configured to carry said raise climber and to align with each of the first rails on the plurality of starter blocks, and a third interface for mating with each of said second interfaces on said plurality of starter blocks to align said first and second rails for permitting movement of said raise climber from said transporter onto any one of said starter blocks;

supporting said raise climber on said transporter;

deploying said raise climber onto one of said starter blocks to permit said raise climber to be used in the corresponding one of said plurality of raises;

enabling said raise climber to return to said transporter;

moving said transporter to another one of said starter blocks; and deploying said raise climber onto another one of said starter blocks to permit said raise climber to be used in another one of said plurality of raises.

2. The method according to claim 1, wherein enabling said raise climber to return to said transporter comprises interfacing said second body with a corresponding first body on said one of said starter blocks.

3. The method according to claim 1, further comprising moving said transporter away from said one of said starter blocks subsequent to deploying said raise climber onto said one of said starter blocks.

* * * * *